US005430692A

United States Patent [19]

Grupp et al.

[11] Patent Number: 5,430,692

[45] Date of Patent: Jul. 4, 1995

[54] WATCH COMPRISING A DEVICE FOR INDICATING THE TEMPERATURE

[75] Inventors: Joachim Grupp, Neuchâtel; Jean-Charles Poli, La Chaux-de-Fonds; Jean-Philippe Rebeaud, Cressier, all of Switzerland

[73] Assignee: Asulab S.A., Bienne, Switzerland

[21] Appl. No.: 166,073

[22] Filed: Dec. 14, 1993

[30] Foreign Application Priority Data

Dec. 17, 1992 [CH] Switzerland ..... 03843/92

[51] Int. Cl.[6] ..... G04B 47/06

[52] U.S. Cl. ..... 368/11

[58] Field of Search ..... 368/11, 10

[56] References Cited

U.S. PATENT DOCUMENTS 3,514,939 6/1970 Cattin .

FOREIGN PATENT DOCUMENTS 7420269 12/1974 Germany .

8714620 5/1988 Germany .

2135081 8/1984 United Kingdom .

OTHER PUBLICATIONS

JP-A-58 117 429, Patent Abstracts of Japan, vol. 7, No. 228 (P-228), 8 Oct. 1983.

*Primary Examiner*—Bernard Roskoski

*Attorney, Agent, or Firm*—Pollock, Vande Sande & Priddy

[57] ABSTRACT

The invention relates to a watch comprising a device for indicating the temperature (16) of the environment in which the watch is situated comprising a first series of thermochromic liquid crystal temperature sensors (18) facing a first temperature scale (20) arranged in such a way that the reading given by the sensors (18) of the first series, in combination with said scale, is directly representative of the temperature of the environment in contact with the sensors, and wherein the device differentiates the temperature indicated by the sensors according to whether the watch is worn or not worn.

12 Claims, 2 Drawing Sheets

WATCH COMPRISING A DEVICE FOR INDICATING THE TEMPERATURE

The invention relates to a watch comprising a device for indicating the temperature of the environment in which the watch is situated and in particular such a watch in which the indicating device is of thermochromic type and comprises means to enable an exact reading of the temperature to be given, whether the watch is worn or not.

BACKGROUND OF THE INVENTION

Germany utility models Nos. 87 14 620 and 74 20 269 already disclose thermometer-watches equipped with liquid crystal temperature indicators.

These liquid crystal indicators comprise a plurality of discret thermochromic sensors, arranged facing a temperature scale, which reflect different coloured light and/or which have a different contrast according to the temperature. The temperature can thus be read directly with the aid of the graduated scale arranged facing the sensors.

A thermometer-watch of this type, however, has the disadvantage of not taking account of the influence of thermal contact with the body of the person wearing it so that the temperature reading obtained is inaccurate when the watch is worn. Indeed, if the temperature of an unworn watch varies linearly in accordance with the temperature of the environment in which it is situated, the same does not apply when the watch is worn. In the latter case, if the ambient temperature is low, the sensors will be at a higher temperature than the ambient temperature because the watch is in direct thermal contact with the body of the wearer, whilst if the ambient temperature is higher than that of the body, the phenomenon is reversed.

To obviate this drawback, there are thermometerwatches having temperature sensors such as thermistors connected to measuring circuits and comprising a switch which can be activated according to whether the user wishes to measure a temperature while the watch is worn or while the watch is not worn.

However, these thermometer watches use complicated electronic corrective circuits and are therefore of a high cost price.

It is thus the main aim of the invention to remedy the drawbacks of the above mentioned prior art by providing a watch comprising an indicating device which allows an exact temperature reading to be given of the environment in which the watch is situated, regardless of whether the watch is worn or not, and to do so in a simple and cost effective manner.

SUMMARY OF THE INVENTION

The object of the invention is therfore to provide a watch comprising a device for indicating the temperature of the environment in which the watch is situated, comprising a first series of thermochromic liquid crystal temperature sensors arranged facing a first temperature scale, in such a way that the reading given by said first seried of sensors, in connection with said first scale, is representative of the temperature of the environment in contact with the sensors, characterised in that it also comprises means for differentiating the temperature indicated by said sensors, according to whether said watch is worn or not worn.

These features enable the watch according to the invention to be free of the influence of the wearer's body temperature in a simple manner and to indicate, reliably and accurately, the temperature of the environment in which it is situated, for example the atmospheric temperature, whether the watch is worn or not.

In a first embodiment of the watch according to the invention, the differentiation means comprise a second temperature scale arranged facing said sensors, said second scale being arranged to give, in combination with said sensors, a representative reading of the temperature of said environment when the watch is worn.

Thus, the temperature of the environment can easily be read by the user whether the watch is worn or not.

In a second embodiment of the watch according to the invention, the differentiation means comprise a second series of liquid crystal thermochromic sensors arranged facing said first scale and arranged in such a way as to give, in connection with said scale, a representative indication of the temperature of said environment when the watch is worn.

This embodiment permits the watch to display the temperature accurately, at the same time conferring on the watch an original and attractive appearance due to the simultaneous colouring of at least two sensors.

Other features and advantages of the invention will appear more clearly from the following description of embodiments of the invention, which are given purely by way of illustrative and non-limitative examples, such description being given in connection with the attached drawings.

DESCRIPTION OF PREFERRED EMBODIMENTS

Figure 1:
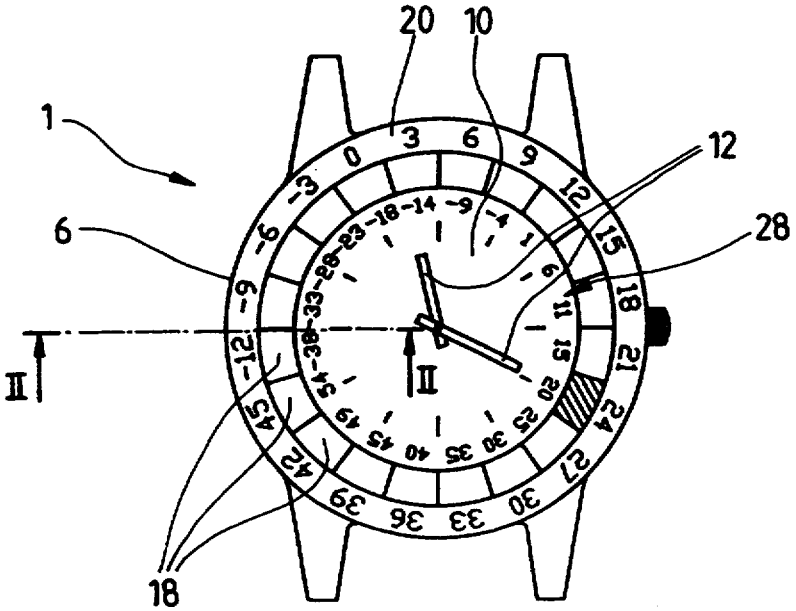
FIG. 1 is a plan view of a first embodiment of a watch according to the invention.
Figure 2:
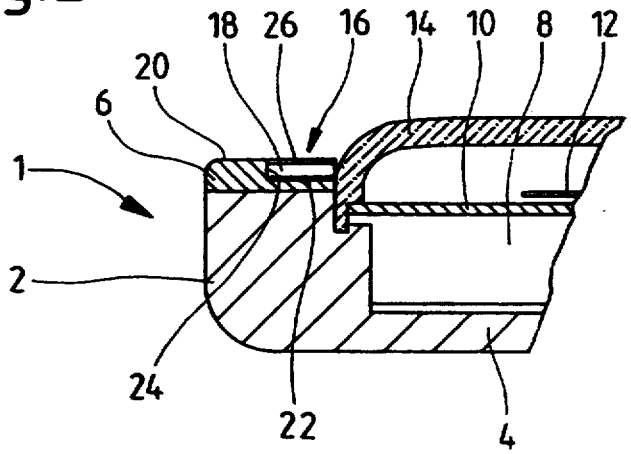
FIG. 2 is a cross-section taken along the line I—I of the watch of FIG. 1.

The watch shown in FIGS. 1 and 2 comprises a bezel 6 and a watchcase 1 comprising an integrally formed caseband 2 and bottom 4. The watchcase 1 contains a watch movement 8 carrying a dial 10 and two hands 12, and is enclosed by a glass plate 14. According to the invention, the watch further comprises a device 16 for indicating the temperature of the environment in which it is situated, whether it is worn or not.

The temperature indicating device 16 comprises a first series of thermochromic liquid crystal temperature sensors 18 which each change colour at a predetermined temperature. These sensors 18 are arranged facing numerical markers forming a first temperature scale 20, called the physical temperature scale. Indeed, this physical scale 20 is calibrated so that the temperature reading given by the sensors 18 is representative of the temperature of the environment in contact with the sensors, that is to say of the temperature of the environment in the vicinity of the sensors.

The sensors 18 are made up of discreet sensor elements which are fixed by an adhesive film 22 in an annular recess 24 arranged in the bezel 6 and are covered with a protective varnish 26. These sensor elements extend to the periphery of the watchcase, each covering a zone in the shape of a ring and each being linked to the numerical marker of the temperature to which they are sensitive or, in other words, to the temperature at which they change colour.

According to this first embodiment of the invention, the temperature indicating device 16 further comprises means for differentiating the temperature indicated by the sensors 18 according to whether the watch is worn or not, that is to say in the latter case away from the body of the wearer.

According to this first embodiment, the means for differentiating the temperature indicated by the sensors 18 comprise a second temperature scale 28, called the compensatory scale and which is arranged, like the first scale 20, facing the sensors 18. This second scale 28 is, however, calibrated to indicate a temperature representative of the temperature of the environment when the watch is worn.

This second scale may include a mark distinguishing it from the first scale in order to facilitate reading and to avoid any errors in reading.

To this end, one may consider representing the two scales 20 and 28 in different colours or placing a suitable code or inscription next to the scales 20 and 28.

In the example disclosed, the first scale 20 is arranged on the bezel 6 and the second scale is arranged on the dial 10.

The temperature reading of the environment in contact with the sensors 18 is carried out respectively in combination with the first 20 scale or the second 28 scale according to whether the watch is not worn or worn.

As shown in FIG. 1, the temperature indicated by the watch when it is worn is given by the hatched sensor 18 in combination with the second scale 28 and is 20° C., while the temperature indicated when the watch is not worn is given by the same sensor 18 but in combination with the first scale 20 and in this instance the temperature indicated is 24° C.

Figure 3:
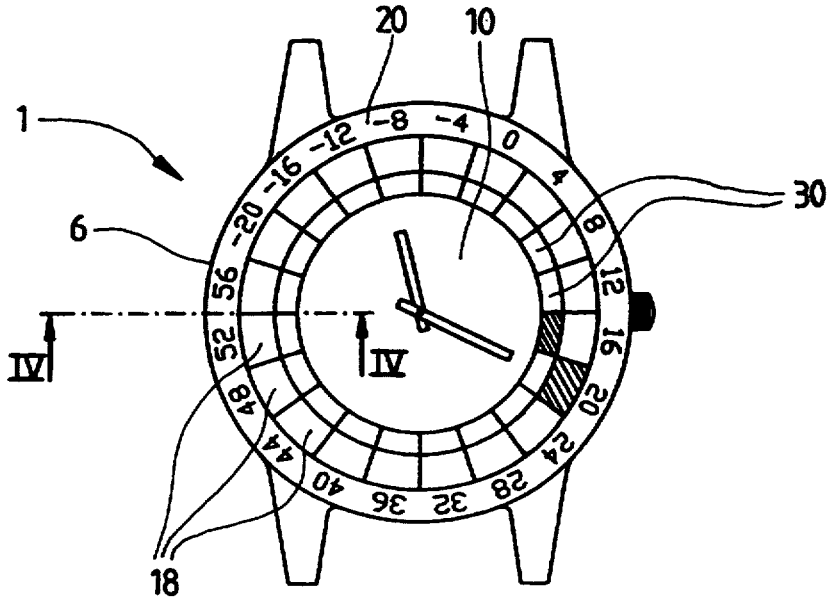
FIG. 3 is a plan view of a second embodiment of a watch according to the invention.
Figure 4:
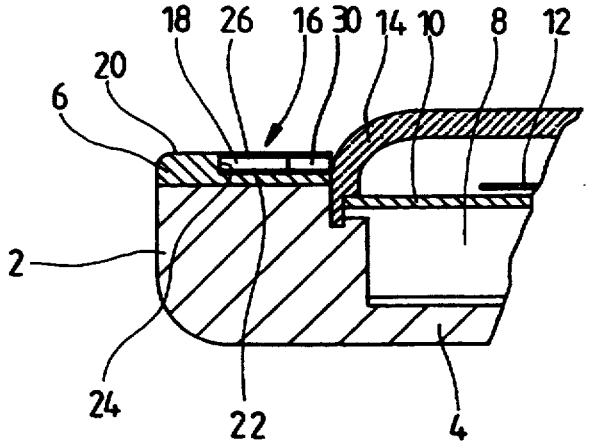
FIG. 4 is a cross-section of the line III—III of the watch of FIG. 3.

Referring now to FIG. 3 and 4, a second embodiment of the watch according to the invention is shown in which the elements represented in FIGS. 1 and 2 are indicated by the same numerical references.

Unlike the first embodiments, the differentiation means comprise a second series of thermochromic liquid crystal sensors 30 which face the first scale 20, so that the reading which they give is representative of the temperature of the said environment when the watch is worn.

Preferably, the second series of sensors 30 is arranged concentrically to the first scale 18 and the sensor elements 30 of this second series are fixed in the recess 24, which is arranged in the bezel 6, in contact with those of the first series 18. Thus each of the sensors in the first series and in the second series faces a single temperature indication in the same scale, facilitating the reading of the temperature.

In the example shown in FIG. 3, sensors 18 and 30, which react to a same temperature, are staggered in relation to each other facing scale 20. Thus two sensors, from the first and second series respectively, are permanently coloured and indicate, according to the series in which they are situated, the temperature of the environment when the watch is worn and not worn. Here, when the watch is worn, the temperature is 16° C., whereas the temperature is 20° C. when the watch is not worn.

It should be noted that the bezel 6 is preferably made of a material affording high thermal conduction such as aluminium or similar and that the caseband and the bottom are preferrably made of a thermally insulating material, for example, in synthetic or ceramic materials.

Of course, the sensors 18 and 30 may be of any other shape and may be arranged in a different way on the watchcase.

It will be observed that, in the event that the watch is immersed in a liquid at a temperature very different to the body temperature, the temperature indicated by the sensors 18 is representative of the temperature of the environment whether the watch is worn or not because the influence of the wearer's body temperature in that case is negligible.

What is claimed is:

1. A watch comprising a watchcase and a device for indicating the temperature of the environment in which the watch is situated, said watchcase comprising means for permitting contact of the watch with a part of the body of a wearer, and said device comprising a first series of thermochromic liquid crystal temperature sensors facing a first temperature scale arranged in such a way that the reading given by the sensors of said first series, in combination with said scale, is directly representative of the temperature of the environment in contact with said sensors, and means for differentiating the temperature indicated by said sensors according to whether the watch is in contact with said body or is not in said contact.

2. A watch according to claim 1, wherein said differentiation means comprises a second temperature scale arranged facing said sensors, said second scale being arranged to give, in combination with said sensors, a representative reading of the temperature of said environment when said watch is worn.

3. A watch according to claim 1, wherein said differentiation means comprises a second series of thermochromic liquid crystal sensors arranged facing said first scale and arranged in such a way as to give, in combination with said first scale, a representative reading of the temperature of the environment when said watch is worn.

4. A watch according to claim 1, wherein said indicating device and said differentiation means are positioned at the periphery of a case of said watch.

5. A watch according to claim 4, wherein said indicating device and said differentiation means are positioned on a ring-shaped bezel of said watch.

6. A watch according to claim 5, wherein said bezel is made of a material affording high thermal conduction.

7. A watch according to claim 2, wherein said indicating device and said differentiation means are positioned at the periphery of the watchcase of said watch.

8. A watch according to claim 7, wherein said indicating device and said differentiation means are positioned on a ring-shaped bezel of said watch.

9. A watch according to claim 8, wherein said bezel is made of a material affording high thermal conduction.

10. A watch according to claim 3, wherein said indicating device and said differentiation means are positioned at the periphery of the watchcase of said watch.

11. A watch according to claim 10, wherein said indicating device and said differentiation means are positioned on a ring-shaped bezel of said watch.

12. A watch according to claim 11, wherein said bezel is made of a material affording high thermal conduction.

* * * * *

UNITED STATES PATENT AND TRADEMARK OFFICE

CERTIFICATE OF CORRECTION

PATENT NO. : 5,430,692

DATED : July 4, 1995

INVENTOR(S) : Joachim GRUPP et al.

It is certified that error appears in the above-indentified patent and that said Letters Patent is hereby corrected as shown below:

Column 4, lines 36 and 43, change "worn" to --in contact with said body--; and line 46, change "a case" to --the watchcase--.

Signed and Sealed this

Twenty-second Day of August, 1995

*Attest:*

*Attesting Officer*

BRUCE LEHMAN

*Commissioner of Patents and Trademarks*